United States Patent [19]

Keltner

[11] Patent Number: 4,936,436

[45] Date of Patent: Jun. 26, 1990

[54] PUSH COIN ACCEPTOR

[76] Inventor: James P. Keltner, 7283 S. Costilla, Littleton, Colo. 80123

[21] Appl. No.: 332,160

[22] Filed: Apr. 3, 1989

[51] Int. Cl.[5] ..... G07D 5/08

[52] U.S. Cl. ..... 194/318

[58] Field of Search ..... 194/317, 318, 319

[56] References Cited

U.S. PATENT DOCUMENTS

| | | | |
|---|---|---|---|
| 3,763,984 | 10/1973 | Greenwald et al. | 194/238 |
| 4,108,296 | 8/1978 | Hayashi et al. | 194/318 |
| 4,359,148 | 11/1982 | Davies | 194/319 |
| 4,416,364 | 11/1983 | Bellis et al. | 194/319 |
| 4,437,558 | 3/1984 | Nicolson et al. | 194/334 X |
| 4,666,027 | 5/1987 | Ostroski et al. | 194/318 X |

FOREIGN PATENT DOCUMENTS

| | | | |
|---|---|---|---|
| 2121579 | 12/1983 | United Kingdom | 194/317 |

*Primary Examiner*—F. J. Bartuska

[57] ABSTRACT

A coin receiving device for use with coin operated vending machines which prevents the coin from leaving the customers hand and completely entering the device until it has been verified as a proper coin. Upon being validated as a proper coin, it is allowed to enter the device where it rolls downward, producing an electrical "coin accepted" pulse to the external coin counting or vending circuitry of the vending device. The need to reject the coin internally and return the bad coin to the customer is eliminated, and hence, the problems of jamming of coins inherent with this coin return process are also eliminated.

2 Claims, 3 Drawing Sheets

PUSH COIN ACCEPTOR

BACKGROUND

1. Field of Invention

This invention relates to coin acceptors for use in coin operated vending and service devices, and in particular, a coin acceptor which will not allow the coin to leave contact with the customers hand and fully enter the acceptor until it has been validated as a good and proper coin.

Background 2. Description of Prior Art.

The objective of a coin operated vending machine is to receive coins, check them for validity as proper coins, and deliver the merchandise or service to the customer. If all goes well between the customer and the machine, the customer is usually happy, and the vending operator makes a fair return on his investment. Unfortunatly, when a vending machine fails to deliver the merchandise or service the customer has paid for, many customers become irate, inflicting damage to the machine. Vandalism by "ripped off" customers is a major financial loss to operators of unattended vending devices. The malfunctions of vending machines can, in most cases, be traced directly to coin accepting device. The coin acceptor accounts for up to 90% of all vending machine failures.

Several general types of coin acceptors are in use in vending machines today. The very complex acceptors commonly used in soft drink vending machines contain many moving parts, but work quite well in the clean dry environment where these machines are normally located. However, this type of acceptor would have a very short life expectancy if used in a self service car wash where the coin slot would receive water, soap and wax. A compromise of coin selectivity must be made in this harsh environment to eliminate the many small moving parts. The other extreme from the very complex soft drink acceptors would be the very simple type of acceptor used in many self service car washes which checks only the diameter of the coin by means of two opto beams. Between these two extremes are several different types of coin acceptors. Coin slide mechanisms such as described in U.S. Pat. No. 3,763,984 to Greenwald, have been used for many years primarily in laundromat washing machines, and various versions of this type coin acceptor are still supplied on many new machines. When this type of coin acceptor was introduced many years ago, the price of a wash was a single coin, and they worked quite well. As inflation occured, the price increased to require more coins, and various coin slides were developed to keep up with inflated prices. With wash prices up to eight coins today, it has become very difficult to design coin slides that operate properly. one type of slide acceptor stacks four stacks of coins flat in four round openings. Another type uses eight vertical slots in which the coins must be placed to operate it. In either of these types, one bad coin will prevent the slide from operating. The customer may not know which coin is the bad one, leading to confusion as to how to get the device to work. Bent coins can cause jamming in this type of acceptor, as the coins dissapear from view as the slide is pushed in, and can jam in such a way that the slide can not be pulled back out by the normal strength of the customer. Another type of acceptor accepts the coin into an opening in a rotary disc which allows a knob to be turned to release the vend. This type of acceptor is quite simple, but is very non selective as to the coins it will accept.

Coin acceptors utilizing low frequency magnetic detection methods are well known, as described in U.S. Pat. No. 4,359,148 to Davies, which compares the change in the frequency and amplitude as the coin passes an oscillating magnetic field between two coils. Another low frequency magnetic detecting type acceptor which is well known is described in U.S. Pat. No. 4,666,027 to Ostroski and Briski. This acceptor utilizes two sets of coils, one of which contains a sample coin between them, and another which compares the change in the frequency and amplitude as the coin drops between them. it also checks the speed at which the coin drops.

Advantages of the invention will become obvious as the readers ensue the following descriptions and drawings.

DRAWING FIGURES

DRAWING REFERENCE NUMERALS

Figure 1:
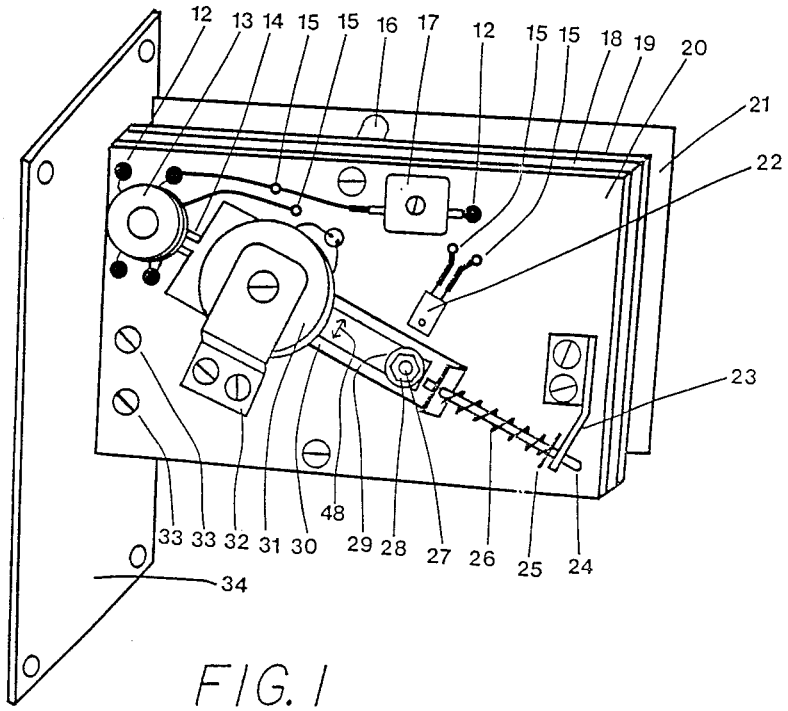
FIG. 1 is a general side view of the acceptor mounted to the face plate.
Figure 2:
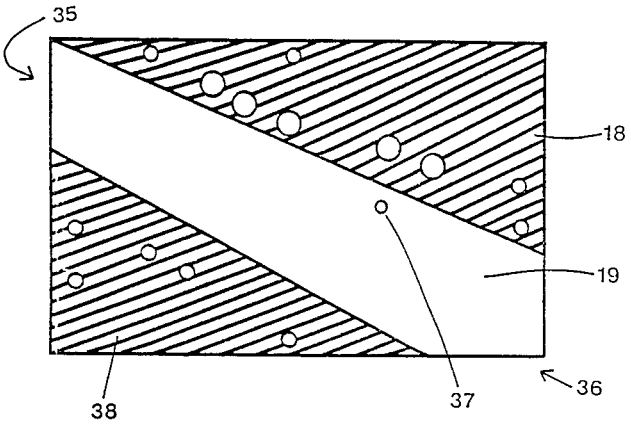
FIG. 2 is a view of the back plate printed circit board with the upper and lower coin guide-spacers in place.
Figure 3:
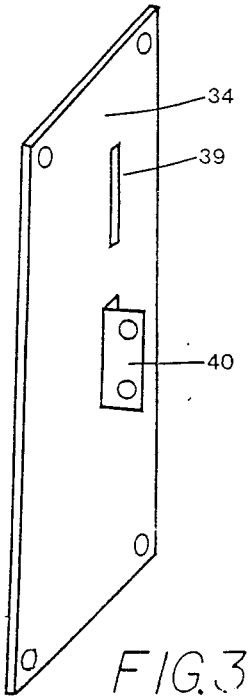
FIG. 3 shows the face plate with the coin slot and bracket.

12. Circuit ground soldering points on printed circuit board.
13. Coils L-1, (top) and L-2 (bottom)
14. Slot in printed circuit board for coin lip.
15. Electrical feedthrough to opposit side printed circuit board.
16. Spacer for holding logic printed circuit board.
17. Variable nulling resistor
18. Upper coin guide-spacer
19. Back plate printed circuit board.
20. front plate printed circuit board.
21. logic printed circuit board.
22. Opto transistor.
23. bracket for spring guide pin.
24. spring guide pin.
25. C-type retainer ring.
26. compression spring.
27. countersunk screw.
28. Nut.
29. Washer.
30. Sliding armature.
31. Electromagnet.
32. Bracket for electromagnet.
33. screws for mounting to bracket on face plate.
34. Face plate with coin slot and mounting bracket.
35. Point of coin entry
36. Point of coin exit.
37. Hole for opto beam.
38. lower coin guide-spacer
39. Coin slot 40. Mounting bracket
41. Threaded round spacer
42. Coin lip on sliding armature.
43. Coil L-3
44. Hole for electromagnet wires.
45. Opto diode.
46. Solder points for wires to logic printed circuit board.
47. Hole for opto beam.
48. Slot in sliding armature.

DETAILED DESCRIPTION OF THE MECHANICAL OPERATION

Figure 4:
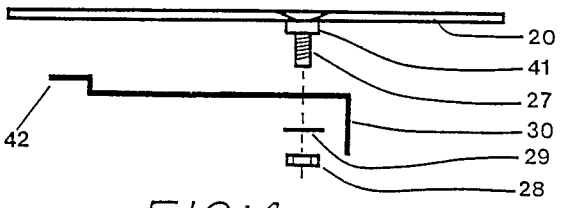
FIG. 4 is a top view of the front plate printed circuit board showing the sliding armature and mounting hardware.
Figure 5:
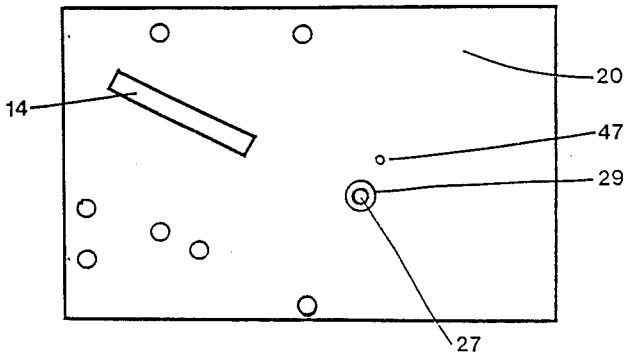
FIG. 5 is a view of the front plate printed circuit board showing the slot for the coin lip of the sliding armature.
Figure 6:
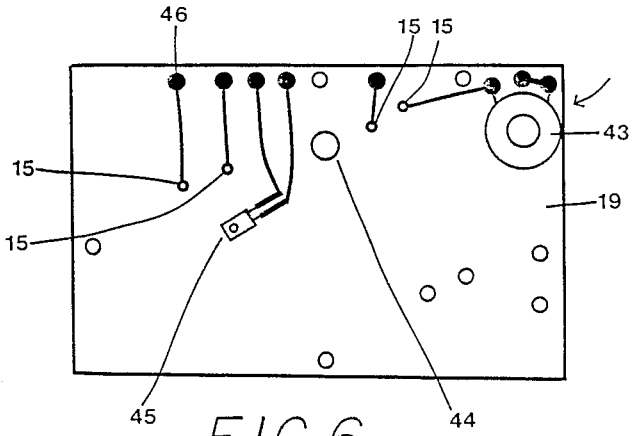
FIG. 6 is a view of the back plate printed circuit board with the components in place.
Figure 7:
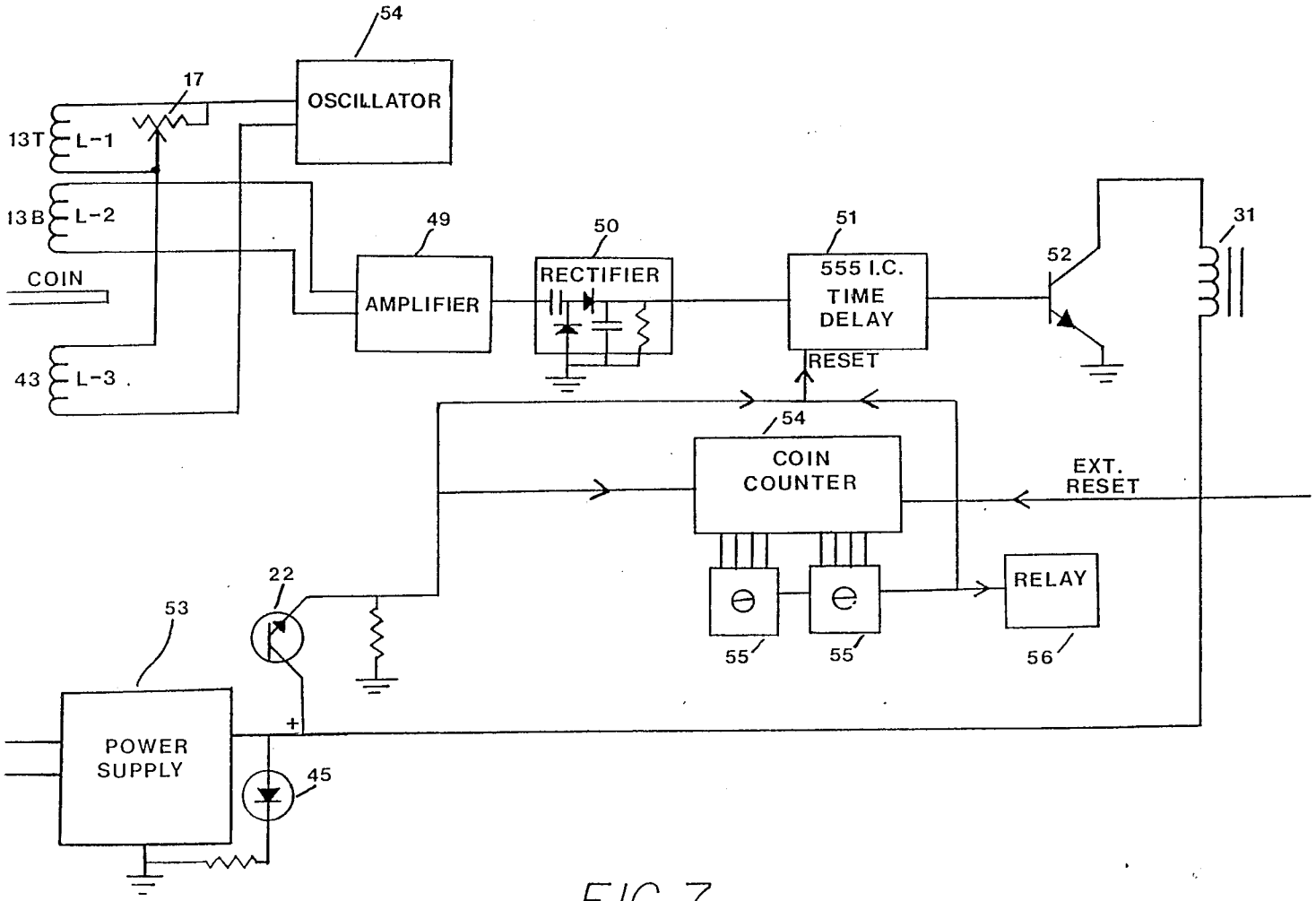
FIG. 7 is a block diagram of the electronic circuitry and logic for controlling the operation.

FIG. 1 shows a general side view of the invention. It is of a sandwich type design consisting of an upper coin guide-spacer, 18, and a lower coin guide-spacer, 38, sandwiched between a back plate printed circuit board, 19, and a front plate printed circuit board, 20. The thickness of the coin guide spacers, 19 and 20, is slightly more than that of the coin and coin slot, 39, so as to allow the coin to roll freely from the point of entry, 35, to the point of exit, 36. The sliding armature, 30, lays flat against the front plate P.C. board, 20, as shown in FIG. 4, with the coin lip, 42, part of the sliding armature, 30, protruding through the slot, 14, into the coin path. The threaded spacer, 41, acts as a nut for holding the countersunk screw, 27, tight, and also as a bearing for the slot, 48, in the sliding armature, 30, to ride on as the armature slides back and forth. The thickness of the spacer, 41, is slightly more than that of the sliding armature, 30, so as to allow the armature to move laterally enough for the coin lip, 42, to be moved out of the coin path when the nut, 28, and washer, 29, are tight. The spring guide pin, 24, protrudes through a hole near the outer end of the L shaped protrusion of the sliding armature, 30. Compression spring, 26, pushes the sliding armature, 30, foreward from that point in such a manner that it not only moves it foreward, but also pushes the coin lip, 42, inward, into the center of the coin path through slot, 14. The electromagnet, 31, is spaced so that when the sliding armature, 30, is drawn to it, the coin lip, 42, will be out of the coin path, but still in the slot, 14, this provides a clear path for the coin to roll through, but keeps the coin lip, 42, aligned to go back into the coin path when released from the electromagnet. The mechanical sequence of operation is as follows: When the customer inserts the coin into the coin slot in the face plate, 34, and into the point of entry, 35, of the acceptor, the coin goes in approximately one third of the way before the leading edge of the coin touches the coin lip, 42, of the sliding armature, 30. At that point, the slight spring action from the compression spring, 26, causes the customer to put a slight pressure on the coin in order to keep it moving foreward. When the coin reaches the point where it is centered between the coils, 13, and 43, the electromagnet, 31, will be energized, snapping the sliding armature, 30, to it. This instantly releases the slight force pushing against the coin, giving the customer the sensation that the coin was pulled into the acceptor. As the coin blocks the opto beam, the electromagnet, 31 will be released. Had the coin been an unacceptable coin, the magnet would not have been energized and the coin would not have been accepted into the acceptor. The coin would never have lost contact with the customers hand, and would have followed his thumb back out of the coin slot. It should be noted here, that the push coin acceptor has only one moving part.

DETAILED DESCRIPTION OF THE ELECTRONIC LOGIC

In order to explain and understand the improved and novel method used in this invention to check and verify the coins, it is necessary to review the operation of the most simular type of coin acceptor, which is in addition to those mentioned under the description of prior art. This well known system of coin checking and verification utilizes two coils connected in series in such a manner that they cancel the magnetic flux in the space between them when they are driven by an alternating current source. The coils are oriented axially at a considerable distance apart. A third coil is located exactly in the center of these two coils. Due to the phasing of the two outside coils, there is a null in the center coil, producing no output voltage. A sample coin is placed between the first outside coil and the center coil. This unballances the coils and there will be an output from the center coil. When a like coin drops between the second outside coil and the center coil, a ballanced condition will occur momentarily, and indicate that a valid coin was dropped. While this simular system works quite well, due to the wide spacing of both outside coils, it is possible for certain undesireable coins to produce a null before they reach the center of the coils. This is due to the spreading out of the magnetic fields around the center coil. My invention will be seen to be improved and novel over the above described well known method as the reader continues with the following description of the invention. This invention also utilizes three coils, L-1, L-2 and L-3, (13-top, 13-bottom, and 43 on the drawings.) Coils L-1 and L-3 are connected in series and out of phase so as to cancel the magnetic field in the center coil, L-2, as they are driven by ocillator, 54. Instead of being equally spaced from the center coil, L-2, driven coil L-1 is very closely coupled to the center coil L-2. It can be interwound on the same form with L-2, but is shown on a seperate coil form for explaination purposes. Coil L-3 and L-2 are spaced far enough apart to allow the coin to drop between them. The magnetic field from coil L-1 is concentrated to a very small area around coil L-2. Since the induced signal from L-1 would many times stronger than that from the more distant L-2, a variable shunt resistor is connected across coil L-1. This reduces the power in coil L-1, and increases the power in the more distant L-3. By adjusting this resistor, a null can be produced in pickup coil L-2. By using this method, the magnetic field generated by coil L-1 is extremely weak and very concentrated to a small area around center coil L-2. For this reason, there is much less effect on the nulling as the coin approaches the center of the coils, With the desired coin temporarilly placed between coils L-2 and L-3, the variable resistor, 17, is adjusted for a null. With the coin removed, there will be an unbalanced condition, and an output from coil L-2. This output is amplified by amplifier, 49, and fed to the rectifier, 50. The positive output of this recifier goes to the input of the 555 I.C. time delay circuit. When a valid coin drops between coils L-2 and L-3, a null, or zero output, occurs in coil L-2. This couses the output of rectifier, 50, to go to zero, which turns on the 555 I.C., 51 This supplies base current to driver transistor, 52, which applies voltage to the electromagnet, 31. This pulls the coin lip, 42 of the sliding armature, 30, out of the coin path, allowing the coin to roll through to the exit point, 36. While the 555 I.C. turns on when the coin enters the center of the coils, the actual time delay function does not start untill the coin leaves the center of the coils. This is done so the coin lip, 42, can not pinch the coin against the back plate P.C. board, 19. The time delay of the 555 I.C. turning off is long enough for the coin to roll past the opto beam, generated by the light emiting diode, 45, and recieved by the opto transistor, 22, but not long enough for the customer to remove the good coin and insert a slug. When the coin breaks the opto beam, the 555 I.C. is reset, prior to the time it would reset from the time delay. In this preferred embodiment version of the invention, the negative pulse generated by the coin breaking the opto beam also serves as a coin counting pulse to a coin counting circuit, 54. Switches, 55, are used to set the price at which the particular device is to vend. When the correct number of coins have been inserted, control relay, 56, is pulled in, controlling the vending device. A reset signal from the coin counting circuit also holds the 555 I.C. reset, so no more coins can be recieved until an external reset signal is sent to the coin counting circuit, 54, by the vending device. When this invention is tuned to the U.S. quarter, which is the primary, but not the exclusive coin that it can be tuned to, and a coil frequency of 4 Mhz. used, no other American or foriegn coin was found that would be accepted. When tuned to various other coins, utilizing various frequencies, the results range from acceptable in selectivity, to totally unacceptable.

What I claim is:

1. A coin receiving and checking device which includes three coils, axially spaced in such a manner that the center coil is tightly coupled to the first outside coil, and spaced a distance from the second outside coil so as to allow a coin to pass between them, and having a variable shunt resistor connected across the first outside coil so as to adjust the ratio of the voltage across the two outside coils which are connected in series with the phases opposing, and fed with an alternating current, in such a manner that a null, or zero voltage will be developed in the center coil when a desirable coin is between the center coil and the second outside coil, and, wherein a mechanical stop is provided to prevent the coin from being pushed further into the device unless a null, or zero voltage is achieved, and electromagnetic means of pulling the coin stop from the coin path when the null is achieved.

2. A coin receiving and checking device as defined in claim 1, wherein the mechanical stop is spring loaded in such a manner that the coin will touch it upon entry into the coin slot, and will compress the spring as it is moved forward until, in the event of an unacceptable coin, the final hard stop will be reached, and the coin will be returned to the point of entry when the user releases the forward pressure, or, in the event of an accepted coin, the forward pressure on the coin overcoming the opposing pressure of the spring will cause the coin to accelerate forward upon the sudden release of the coin stop.

* * * * *